US008395114B2

(12) United States Patent
Fang et al.

(10) Patent No.: US 8,395,114 B2
(45) Date of Patent: Mar. 12, 2013

(54) ION TRAP, MULTIPLE ELECTRODE SYSTEM AND ELECTRODE FOR MASS SPECTROMETRIC ANALYSIS

(76) Inventors: Xiang Fang, Beijing (CN); Chuanfan Ding, Shanghai (CN)

( * ) Notice: Subject to any disclaimer, the term of this patent is extended or adjusted under 35 U.S.C. 154(b) by 770 days.

(21) Appl. No.: 11/991,305

(22) PCT Filed: Aug. 30, 2006

(86) PCT No.: PCT/CN2006/002227

§ 371 (c)(1),
(2), (4) Date: Sep. 2, 2009

(87) PCT Pub. No.: WO2007/025475

PCT Pub. Date: Aug. 3, 2007

(65) Prior Publication Data

US 2009/0321624 A1 Dec. 31, 2009

(30) Foreign Application Priority Data

Aug. 30, 2005 (CN) ..... 2005 1 0093518
Aug. 30, 2005 (CN) ..... 2005 1 0093519
Jan. 16, 2006 (CN) ..... 2006 1 0001017

(51) Int. Cl.
*H01J 49/26* (2006.01)

(52) U.S. Cl. ..... 250/283; 250/281; 250/282; 250/396 R; 250/397

(58) Field of Classification Search ..... 250/281, 250/282, 283, 290, 292, 396 R, 397
See application file for complete search history.

(56) References Cited

U.S. PATENT DOCUMENTS

| | | | | |
|---|---|---|---|---|
| 5,420,425 | A | 5/1995 | Bier et al. | |
| 5,625,186 | A | 4/1997 | Frankevich et al. | |
| 6,441,370 | B1 | 8/2002 | Khosla et al. | |
| 6,838,666 | B2 | 1/2005 | Ouyang et al. | |
| 6,897,438 | B2 | 5/2005 | Soudakov et al. | |
| 2003/0089846 | A1 * | 5/2003 | Cooks et al. | 250/281 |
| 2004/0105160 | A1 * | 6/2004 | Kienzle et al. | 359/619 |
| 2005/0263696 | A1 * | 12/2005 | Wells | 250/292 |
| 2006/0038123 | A1 * | 2/2006 | Quarmby et al. | 250/292 |
| 2007/0063137 | A1 * | 3/2007 | Kalinitchenko | 250/281 |
| 2009/0294655 | A1 * | 12/2009 | Ding et al. | 250/283 |

* cited by examiner

*Primary Examiner* — David A Vanore
*Assistant Examiner* — Nicole Ippolito
(74) *Attorney, Agent, or Firm* — Martine Penilla Group, LLP

(57) ABSTRACT

An ion trap, a multiple-electrode-pole system and an electrode pole for mass spectrometric analysis. The electrode pole (1) is a rod and the shape of at least one side of its cross section is ladder-shape including two or more steps. It develops the structure of the electrode pole; so the mass spectrographs such as the multiple-electrode-pole system and the ion trap and so on using the electrode pole (1) have an optimized field shape and can be made easily with low cost.

40 Claims, 10 Drawing Sheets

ION TRAP, MULTIPLE ELECTRODE SYSTEM AND ELECTRODE FOR MASS SPECTROMETRIC ANALYSIS

FIELD

The present invention relates to the technical field of mass spectrometric analysis, in particularly, to an ion trap, a multipole electrode system and electrode for mass spectrometric analysis which present an optimized field shape and are easy to be manufactured.

BACKGROUND

A quadrupole ion trap is a special device. It may serve as a device to store ions which confines gaseous ions within the region of the quadrupole field of the ion trap in a certain time period, and may also function as a mass analyzer for a mass spectrometer so as to conduct mass spectrometric analysis. In addition, such an ion trap possesses a broad mass range and a variable mass resolution. The quadrupole electrostatic field is generated via introducing a RF (radio frequency) voltage, a DC voltage or a combination signal thereof onto individual electrodes of the ion trap. Traditional ion traps consist of two types of electrode, that is, an annular electrode and an end cover electrode. A typical electrode shape is hyperbolic so as to generate a significant quadrupole field.

Ion traps in early days are three-dimensional ion traps, whose quadrupole field is generated along the r and z directions (in a polar coordinate system). In this quadrupole field, ions are acted upon by linear forces, such that those ions with a mass-to-charge ratio within a certain range are captured and stored in the ion trap. The most typical three-dimensional ion trap is composed of three hyperbolic electrodes, e.g., an annular electrode and two end cover electrodes. Such a device is commonly referred to as a Paul ion trap or a quadrupole ion trap. A columnar ion trap is a simpler ion trap which is composed of an annular electrode with its inner surface being columnar and two end cover electrodes in a flat plate structure.

Both a Paul ion trap and a columnar ion trap suffer most from that only a small number of ions are captured in the trap, and that the capture ratio of incident ions ionized outside the trap is extremely low. In order to suppress the space charge effect so as to attain a higher resolution, a commercial mass spectrometer only captures 500 ions or even less in a typical experiment. The ions that are introduced into the ion trap through the inlet on the end covers will be subjected to the RF field, and only those introduced at proper RF phase could be efficiently captured and stored in the trap. The capture ratio is less than 5% for continuously incident ions, and in most cases it is much lower than 5%.

To solve the above problem, another type of ion trap, that is, a linear ion trap is proposed. Such a linear ion trap is composed of a plurality of elongate electrodes that are in a parallel arrangement. The electrode system will determine the volume of the ion trap. A two-dimensional quadrupole field may be generated in the plane perpendicular to the central axis of the ion trap by applying RF voltage and DC voltage to the electrodes. Since a strong focusing of ions is just realized in a two dimension topology, the captured ions may be distributed around the central axis, and the number of ions that are captured is significantly increased. U.S. Pat. No. 5,420,425 describes a two-dimensional linear ion trap which is composed of three sets of quadrupole electrodes, in which the quadrupole set in the middle is main quadrupole electrode. One pair of main quadrupole electrodes thereof is provided with slots, through which ions may be introduced in and discharged out. The two sets of quadrupole electrodes on the both ends may function to axially restrict the motions of the ions captured in the trap, and also may improve the quadrupole field inside the main quadrupole electrodes. When individual electrodes are hyperbolic electrodes, an almost ideal quadrupole field may be attained.

All above mentioned ion traps, except the columnar ion trap, demand a precise machining process, such as manufacture and assembly, etc. Nevertheless, such high precision processes are very complicated, and therefore become a predominant factor that impairs the applicability of the small-size portable ion trap mass spectrometer.

U.S. Pat. No. 6,838,666 B2 proposes a linear rectangular ion trap, in which four rectangular flat plate electrodes are arranged in parallel to the axis so as to enclose an ion trap with a rectangular cross section. A RF voltage and a DC voltage are applied to the individual flat plate electrodes to generate a quadrupole field in the ion trap, such that ions are focused onto a two-dimensional plane. Axial restriction upon the motions of ions is realized by introducing end electrodes. The rectangular ion trap solves the problem of high precision mechanical processes of the linear ion traps, while at the same time it brings about a new issue, i.e., a substantial uncertainty in ion motions resulting from the fact that high order fields residing in the quadrupole field produced by the four flat plate electrodes, such as a dodecapole field and an icosapole field. In this way, the mass resolution of the ion trap mass spectrometer is impaired.

Early studies of field shape demonstrated that the introduction of higher order fields tended to impair the mass resolution of a quadrupole mass spectrometer. However, the latest researches show that the mass resolution of a quadrupole mass spectrometer may be improved effectively by properly introducing components of higher order fields. For example, in U.S. Pat. No. 6,897,438 B2, parameters of a quadrupole electrode system (such as the ratio of radii or fields of two pairs of electrodes) are changed to introduce an octopole field into a quadrupole filed, such that the mass resolution is improved. This patent only discloses a method to introduce an octopole field into a quadrupole field, that is, changing radii of the electrodes or radii of the fields, without mentioning any method for introducing other higher order fields.

In summary, a two-dimensional ion trap is a linear ion trap that can realize a large capacity and solve the problem that the number of ions captured by a three-dimensional ion trap is small and thus the capture efficiency is low. However, an existed two-dimensional ion trap either demands high precision machining, or contains significant higher order fields. These disadvantages may impair the development of small-size portable ion trap mass spectrometers. On the other hand, introduction of higher order fields should be taken into considerations in the studies of field shape optimization for quadrupole mass spectrometers. However, the prior patents only discuss the introduction of an octopole field and propose no practical technical solutions to introduce other higher order fields. Investigations for an ion trap and a mass spectrometer thereof having flexible structures, being easy to be manufactured, and conveniently attaining an optimized field shape will significantly promote the development of small-size portable ion trap mass spectrometers.

In a mass spectrograph is often employed a multipole electrode system of an ion optical system. In the field of mass spectrometry, a multipole electrode system is generally employed as an ion optical system. For example, quadrupole electrodes, hexapole electrodes, or octopole electrodes, etc., is applied as an ion lens or an ion guiding system. The field shape in the regions of such multipole electrodes are very important for ion transferring and focalizing.

Most electrodes in the prior art multipole electrode system are cylindrical or hyperbolic electrodes. It is well known that hyperbolic electrodes are difficult to be manufactured and assembled in a high accuracy. As for cylindrical electrodes, even though they may be manufactured in a high accuracy, they cannot be assembled in a high accuracy. In this sense, the manufacture and assembly limit its performance.

U.S. Pat. No. 6,441,370 B1 proposed a rectangular linear multipole electrodesystem, which may be used for ion guiding and may be used in ion traps. This multipole electrode system employs an electrode with a rectangular section. The surface of the rectangular electrode is superimposed with a surface layer, which functions to improve the field shape. The manufacture and assembly will be greatly simplified by employing a rectangular electrode. However, this patent did not disclose the concrete technical solution capable of improving the field shape. The surface layer can only improve the field shape qualitatively, and it can not realize this in a quantitative way.

If the desired multipole field shape could not be realized, the machining (including manufacture and assembly) of the multipole electrode system could not be performed in a high accuracy, then the performance of the multipole electrode system, and hence the ion optical system in a mass spectrograph will be seriously affected. Therefore, it is desirous to develop a multipole electrode system, which presents an optimized field shape and a flexible structure, is easy to be manufactured, and has a low manufacture cost, so as to construct such an ion optical system that has a stable performance and is capable of controlling the ion trajectories precisely.

SUMMARY

A technical problem to be solved in the invention is to provide an electrode for mass spectrometric analysis, the structural improvements of which impart an optimized field shape, an easiness in manufacture and thus a low manufacture cost to a mass spectrograph, such as a multipole electrode system and an ion trap, that employs this electrode.

A further technical problem to be solved in the invention is to provide a multipole electrode system for mass spectrometric analysis, the structural improvements of which not only impart to it an optimized field shape, but also make it flexible in structure and easy to be manufactured, thus resulting in a low manufacture cost.

A further technical problem to be solved in the invention is to provide an ion trap for mass spectrometric analysis, the structural improvements of which not only impart to it an optimized field shape, but also make it flexible in structure and easy to be manufactured, thus resulting in a low manufacture cost.

The above technical problems are solved by adopting the following technical solutions.

An electrode for mass spectrometric analysis, with the electrode in a columnar form, at least one side of the cross section of the columnar electrode has a step-like shape with two or more steps.

The invention further provides a multipole electrode system for mass spectrometric analysis, comprising two or more pairs of columnar electrodes, and a power supply connected to the electrodes, said columnar electrodes are arranged in a straight columnar shape centered on a Z axis parallel to the generatrix of the electrode, characterized in that, at least one side of the cross sections of at least one pair of the electrodes has a step-like shape with two or more stages.

In the invention, preferably, at least one side of each cross section of all the electrodes of the multipole electrode system has a step-like shape with two or more steps.

As an alternative embodiment, the multipole electrode system has two pairs of electrodes so as to form a quadrupole electrode system.

As another alternative embodiment, the multipole electrode system has three pairs of electrodes so as to form a hexapole electrode system.

As a further alternative embodiment, the multipole electrode system has four pairs of electrodes so as to form an octopole electrode system.

In the multipole electrode system of the invention, the electrodes are fixed on a same circumference centered on the Z axis, with circumferential angles therebetween being equal to each other.

In the multipole electrode system of the invention, the power supply provides a DC signal or a RF signal, or a combination thereof.

In the invention, a mixed field composed of multipole fields with specific contributing components may be obtained through varying the multipole electrode system with respect to the number of steps of cross sections and the shape parameters of each step.

The invention also provides an ion trap for mass spectrometric analysis, comprising a quadrupole electrode system with two pairs of columnar electrodes; end electrodes located on two ends of the quadrupole electrode system; a RF signal generating a RF ion capture electric field; and a DC signal generating an axial ion capture potential well; wherein at least one side of the cross sections of at least one pair of columnar electrodes has a step-like shape with two or more steps.

In the ion trap of the invention, as an alternative example, the end electrodes may be flat plate electrodes.

In the ion trap of the invention, as another alternative example, the end electrodes may be constituted by a quadrupole electrode system with two pairs of columnar electrodes, wherein at least one side of the cross sections of at least one pair of electrodes has a step-like shape with two or more steps.

In the ion trap of the invention, as a further alternative example, the end electrodes may be formed through combining a quadrupole electrode system with two pairs of columnar electrodes and flat plate electrodes located at ends of the quadrupole electrode system, wherein at least one side of the cross sections of at least one pair of electrodes has a step-like shape with two or more steps.

In the ion trap of the invention, at least one side of each cross section of the two pairs of electrodes has a step-like shape with two or more steps.

In the ion trap of the invention, at least one of the electrodes or the end electrodes is provided with slots or small holes for introducing or discharging ions.

In the ion trap of the invention, a mixed field composed of multipole fields with specific contributing components may be imparted to the ion trap by varying the number of steps of cross sections of the electrodes and the shape parameters of each step. The mixed field contains a quadrupole field and an octopole field.

A plurality of ion traps of the invention may be serially arranged to constitute a multi-stage ion treating system for conducting $MS^n$ analysis experiments In the invention, both sides of the cross sections of the said electrode have a step-like shape with two or more steps.

In the invention, the step widths of the said electrode with the side in a step-like shape decreases stepwise form an outer side to an inner side.

In the invention, the shapes of the two sides of the cross sections of the said electrode are arranged in a symmetrical manner, or in an asymmetrical manner.

In the invention, the two sides of the cross sections of the electrode may have a same number of steps.

In the invention, the step-like side with two or more steps of the said electrode is integrally manufactured, or the said electrode is formed by combining individual steps that have been manufactured individually.

In the invention, the side of each step of the said electrode with step-like cross sections has a shape of a step surface with right angles, or a cylindrical surface, or a hyperbolic surface or an oval surface.

As a particular example, each step of the cross sections of the said electrode has a rectangular shape.

The ion trap, the multipole electrode system and the electrode for mass spectrometric analysis which employ the above structures of the invention can effectively realize field shape optimization in the ion trap and in the multipole electrode system, because the columnar electrodes employ a structure that the side of the cross sections has a step-like shape with two or more steps. The boundary shape of the RF electrode may be designed according to various requirements of the field shape, such as obtaining an ideal quadrupole field shape as much as possible, or a mixed field shape composed of specific contributing components of a quadrupole field or other higher order fields. In addition, since the RF electrode constituted by the step-like electrode may employ a simply shape that is easy to be manufactured and assembled (for example, the surface of the step-like electrode is constituted by combination of planes and cylindrical surfaces, etc.), the manufacture and assembly accuracy can be greatly improved, and the contradiction between the ideal field shape in a mass spectrometer (such as a multipole electrode system, an ion trap), and the manufacture and assembly of electrodes may be solved.

In summary, since the step-like electrode according to the invention may have a step surface of arbitrary face shapes, the field shape may be optimized by conveniently changing the surface shape of the electrode, that is, changing the boundary conditions of the electrical field, which is realized by adjusting the number of steps of the electrode and the parameters of each step. Field-shape optimizing multipole electrode system and ion traps or the like employing the step-like electrodes with two or more steps may solve the prior art contradiction between the ideal field shape in a mass spectrometer (such as a multipole electrode system, an ion trap) and the manufacture and assembly of electrodes. At the same time, under the guidance of research results on the higher order field theory, the boundary conditions for the electrodes required by the desired field shape may be conveniently and flexibly imposed, such that theoretic results thereof may be effectively converted into a practical device. The field-shaping optimizing multipole electrode system composed by step-like electrodes with two or more steps provides a practical solution, in which the field shape may be optimized, the manufacture is easy and the cost is low, to a quadrupole mass analyzer and other ion optical systems (such as an ion guiding system, etc.) in a mass spectrograph.

DRAWINGS

DETAILED DESCRIPTION OF EMBODIMENTS

Figure 1:
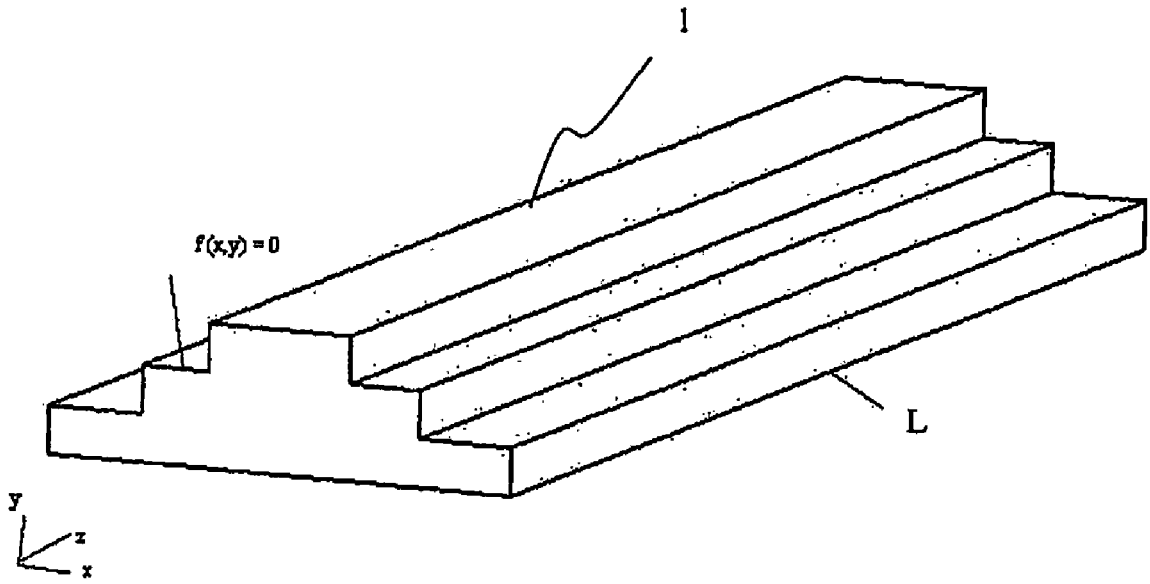
FIG. 1 is a schematic view illustrating the structure of a step-like electrode of the invention.
Figure 2:
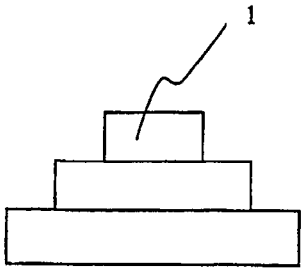
FIGS. 2 to 9 show the cross section shapes of the step-like electrode of the invention.
Figure 3:
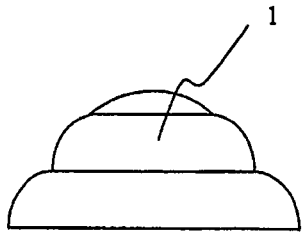
Figure 4:
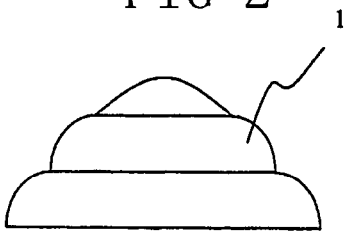
Figure 5:
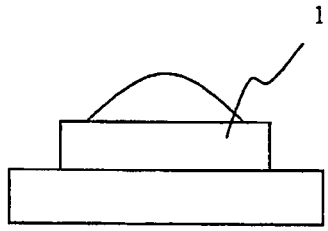
Figure 6:
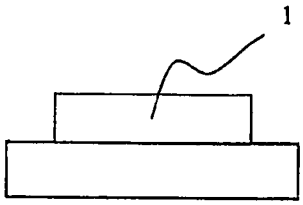

The electrode structure for mass spectrometric analysis according to the invention is shown in FIGS. 1 to 9. The electrode 1 is in a columnar form, with at least one side of its cross section having a step-like shape containing two or more steps. FIGS. 1 to 9 show several structures of electrodes 1 with three steps, and FIGS. 11 to 16 show several structures of electrodes 1 with two steps. Nevertheless, these figures are only some examples. The electrode 1 according to the invention may assume more steps, such as, 4 steps or 5 steps, etc; and its shape may vary in requests. Detailed descriptions thereof are omitted herein. As shown in FIG. 1, the columnar surface of the electrode 1 is a trace formed by the movement of an electrode generatrix L, which is parallel to a given straight line, along the electrode directrix $f(x,y)=0$. The electrode directrix $f(x,y)=0$ takes a form of a stepwise function. When the electrode 1 is applied in a mass spectrometric analyzer, the form of the steps of the electrode 1 may be determined according to the desired field shape. In addition, a computational model may be established according to its form. A mixed field having multipole fields with specific contributing components, i.e., the required optimized field shape may be obtained by varying the configurations, such as the number of the steps and the dimensional parameters of each step, so as to determine the boundary conditions and the optimal combination of the electrodes. A commonly used optimized field shape may be a quadrupole field, or a mixed field comprising a quadrupole field and an octopole field, or a mixed field comprising a quadrupole field and other multipole fields.

Figure 13:
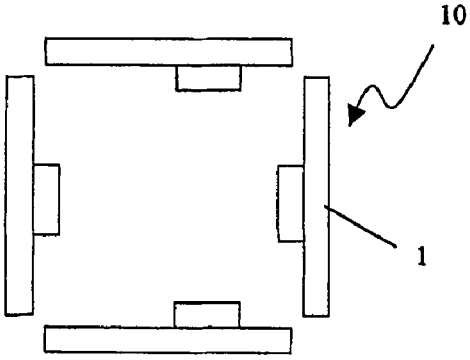
Figure 14:
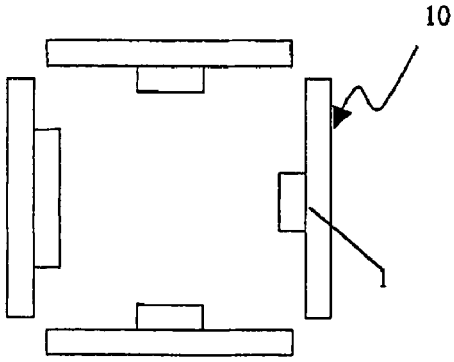
Figure 15:
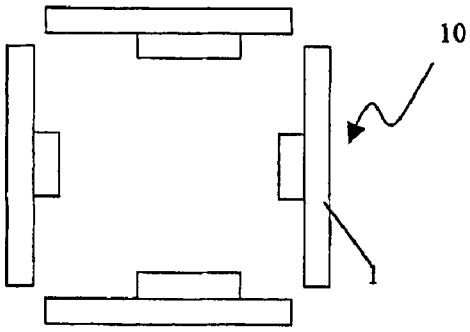
Figure 16:
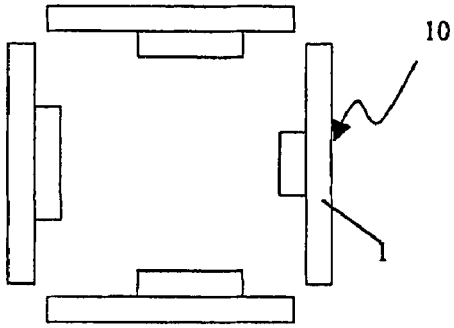

In the invention, as shown in FIGS. 1 to 9, the shapes of both sides of the cross section of the electrode 1 may be in a step form containing two or more steps. The shapes may be in a symmetric arrangement as shown in FIGS. 1 to 5, or be in an asymmetry arrangement as shown in FIGS. 13, 15 and 16.

The step width of each step of the electrode 1 with its sides in a step from may decrease stepwise.

In the invention, it is preferable that the numbers of the steps at the both sides of the cross section of the columnar electrode 1 may be equal. Thus, the electrode 1 may be decomposed into two or more thin layer units by a set of parallel planes which pass through corresponding separating points. The numbers of the steps at both sides of the cross section of the columnar electrode 1 may be different in request, for example, there are two steps at one side and three steps on the other (not shown in the figures).

In the electrode 1 of the invention, the side curves of individual steps may be arbitrary, in other words, the side of each step may comprise an arbitrary curved surface, such as a plane, a columnar surface, a hyperbolic surface, and an elliptical surface, etc. In this way, the columnar shape of the electrode 1 constituted by two or more steps may be constituted in such a manner that each step is formed by the same curved surfaces or planes, or the steps are formed by different curved surfaces. In any case, the columnar surface of the electrode 1 is formed by the combination of the plurality of curved surfaces. By way of example, the electrode 1 may be a columnar body formed by the combination of a pair of parallel planes and a columnar surface, a hyperbolic surface, an elliptical surface or other curved surfaces. The electrode directrix $f(x,y)=0$ may generate various shapes of columnar surfaces. The electrical field boundary conditions required for generating the optimized field shape may be embodied in a combination way through choosing the stepwise function properly, that is, through employing appropriate step forms. Each step of the electrode 1 may have an arbitrary surface shape. Nevertheless, from the point of view of accurate manufacture and assembly, those shapes which are simple and easy to be manufactured and assembled may be employed. For example, the surface of the step-like electrode 1 may be formed from a combination of planes, and cylindrical surfaces. Furthermore, as a particular example, the shape of each step of this electrode 1 may be in a rectangular flat plate form so as to attain good accuracy of manufacture and assembly. The electrode 1 resulting from the combination of a plurality of step forms may solve the contradiction between the ideal field shape of the prior art used in a mass spectrometer, such as a multipole electrode system, an ion trap, and the manufacture and assembly of electrodes. In addition, under the guidance of research results on the multipole field theory, the boundary conditions for the electrodes required by the desired field shape may be conveniently and flexibly imposed, such that theoretic results thereof may be effectively converted into a practical device.

Figure 7:
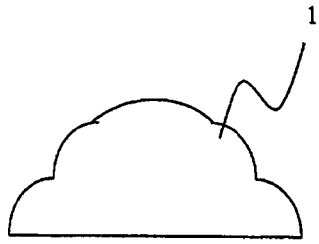
Figure 8:
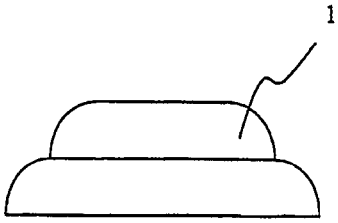
Figure 9:
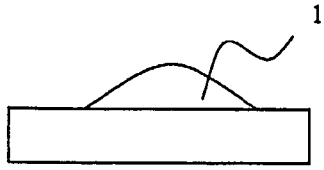
Figure 10:
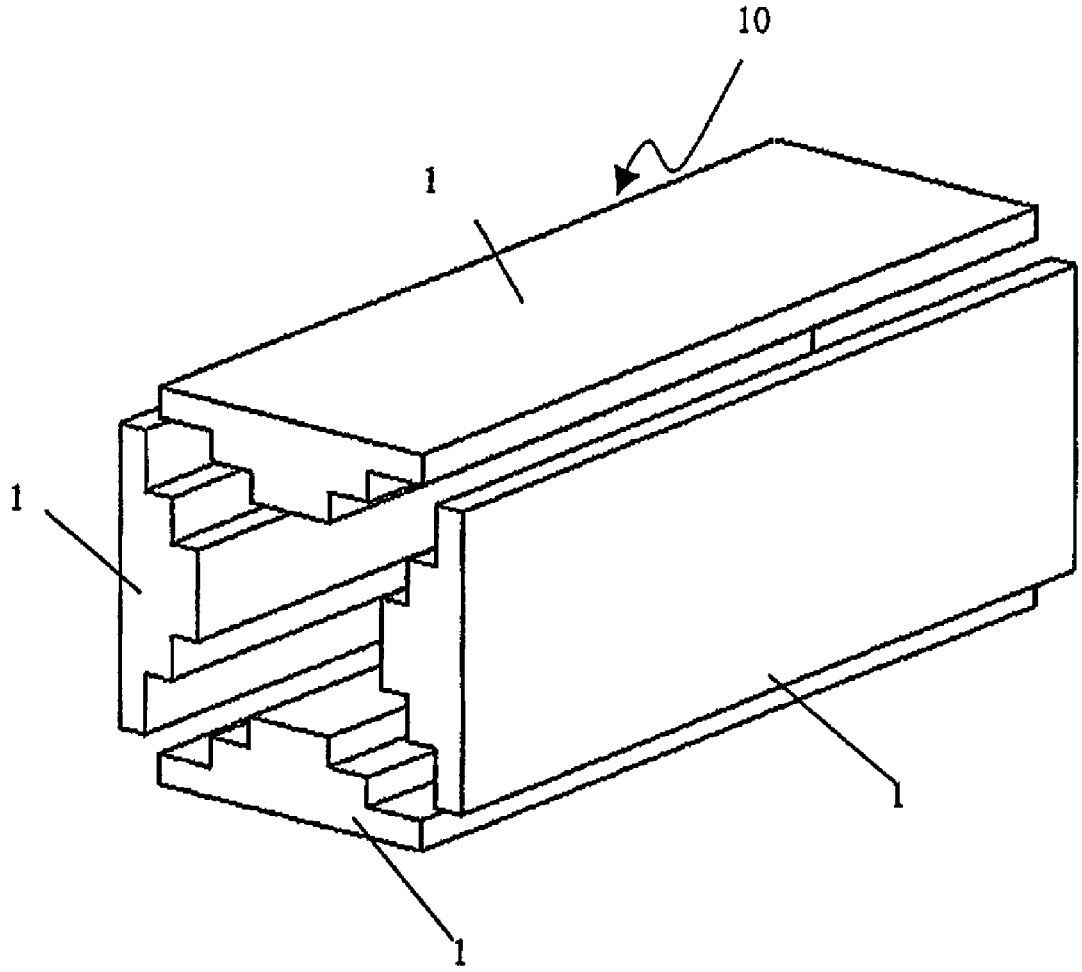
FIG. 10 is a schematic view illustrating the structure of a quadrupole electrode system of the invention.

Shown in FIGS. 2 to 6, FIG. 8 and FIG. 9 is manufacture of the step-like electrode 1 according to the invention, in which individual thin layer units are manufactured respectively and then combined together. The multi-step electrode 1 also may be integrally manufactured, as shown in FIGS. 1 and 7.

The already-existing quadrupole theory reveals that when ideal hyperbolic surfaces are available to the electrode 1, an ideal quadrupole field may be generated in RF operation region, with which good ion analysis results may be obtained. When the field-shape optimizing quadrupole electrodes serve as an ion trap mass analyzer or a linear ion trap, the ion trap constituted by step-like electrodes contains a more significant quadrupole field component than a linear ion trap constituted by flat plate electrodes, such that separation and analysis may be more efficiently realized on the target ions. Therefore, it may be considered that it has an optimized electric field shape.

In actual manufacture processes, it is considerably difficult to obtain ideal hyperbolic surfaces, which substantially limits the analysis performance of a mass analyzer. In the invention, a desirable step-like electrode 1 is obtained by combining a plurality of steps so as to constitute a RF electrode, and dimensional parameters of the steps may be adjusted by adding the number of steps, so as to optimize the filed shape. Theoretically, when the thickness of each step tends to infinitesimal, a RF electrode with ideal hyperbolic surfaces may be obtained in a combination manner. In actual manufacture processes, each step has a definite thickness. Given the shape and parameters of each step, a numerical simulation approach may be employed to obtain the field shape in a mass spectrograph (such as a multipole electrode system and an ion trap) composed of step-like electrodes with two or more steps. On the other hand, the electrode parameters (such as the number of steps, the dimensions of each step and the like) that correspond to the optimized field shape may be obtained from the numerical simulation approach. Therefore, a RF electrode 1 may be manufactured which will present an optimized field shape. Since this electrode in a multi-step form may take a shape which is simple and easy to be manufactured and assembled (for example, the surface of the electrode is constituted by combination of planes, including orthogonal stepped faces, and cylindrical surfaces, etc.), the accuracy of manufacture and assembly may be significantly improved and the manufacture cost may be greatly decreased for mass spectrometers, such as ion traps and multipole electrode systems.

FIGS. 10 to 18 show a multipole electrode system for mass spectrometric analysis, in which the above step-like electrodes are employed. The multipole electrode system contains two or more pairs of columnar electrodes 1 and a power supply connected thereto. The columnar electrodes 1 are peripherally arranged in a straight cylindrical form by taking z axis parallel to the generatrix L as the axial center, wherein at least one side of the cross sections of at least one pair of columnar electrodes 1 is shaped as a step form with two or more steps.

In the invention, it is preferable that at least one side of the cross sections of all columnar electrodes 1 in the multipole electrode system are in a step form with two or more steps.

The multipole electrode system relating to the invention may be employed in the region of quadrupole mass analyzers, for example, a quadrupole electrode in a quadrupole electrode mass analyzer, and may also be applied in other ion optical systems in a mass spectrograph, for example, a quadrupole, hexapole, or octopole electrode system, etc., in ion lens or ion guiding systems. When the field-shape optimizing multipole electrode systems are employed as optical systems, for example, ion focusing or ion guiding systems, DC voltages, RF voltages or voltages in other wave forms may be applied across the electrodes so as to perform focusing and transferring of ions.

As an alternative example, said multipole electrode system may have two pairs of electrodes 1 so as to form a quadrupole electrode system 10, as shown in FIGS. 10 to 16.

In the invention, a mixed field composed of multipole fields with specific contributing components may be attained by varying the number of steps of cross sections of the electrodes 1 and the shape parameters of each step thereof in said multipole electrode system. The following demonstrations will be made by taking a quadrupole electrode system as an example.

FIGS. 11 to 16 illustrate the cross sections of quadrupole electrode systems, capable of generating various mixed fields, which are constituted by step-like RF electrodes 1.

Figure 11:
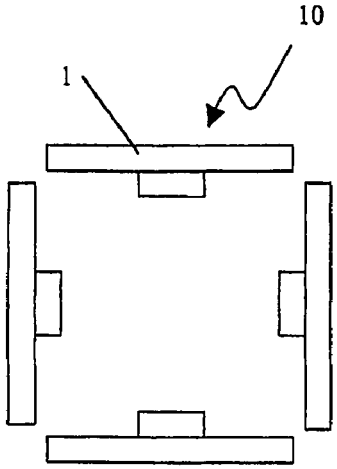
FIGS. 11 to 16 show the cross section shapes of quadrupole electrode system of the invention.
Figure 12:
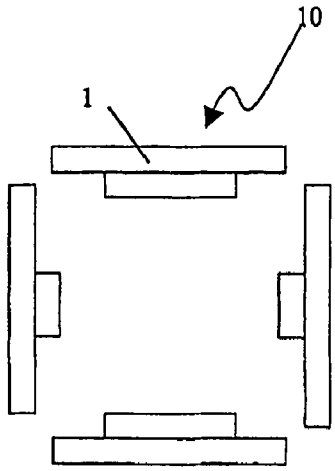

These electrodes are formed by superposing two rectangular thin layer units, each of which has a rectangular cross section. In FIG. 11, four completely identical RF electrodes 1 are employed, and two steps of each RF electrode have a common symmetrical axis; in FIG. 12, two different types of RF electrodes 1 are employed, with the two opposite electrodes being completely identical to each other, and two steps of each electrode have a common symmetrical axis; in FIGS. 13 and 15, two different types of RF electrodes 1 are employed, with the two opposite electrodes being completely identical to each other, and two steps of one pair of electrodes have a common symmetrical axis, two steps of another pair of electrodes have different symmetrical axes; in FIGS. 14 and 16, three different types of RF electrodes 1 are employed, with a pair of electrodes 1 being completely identical to each other and two electrodes in another pair of electrodes being different. Different mixed field may be obtained by taking different electrode parameters. Numerical computations indicate that the structure as shown in FIG. 11 may generate A2, A6, A8, A10, etc., the structure in FIG. 12 may generate A2, A4, A6, A8, A10, etc., the structure in FIG. 13 may generate A2, A3, A6, A8, A10, etc., the structure in FIG. 14 may generate A2, A5, A6, A8, A10, etc., the structure in FIG. 15 may generate A2, A3, A4, A6, A8, A10, etc., and the structure in FIG. 16 may generate A2, A3, A4, A5, A6, A8, A10, etc., wherein 'An' represents a multipole field, with 'n' indicating the number of electrodes contained therein. In other words, 'An' corresponds to a 2n-pole field, for example, A2, A3, A4, A5, A6 respectively correspond to a quadrupole, hexapole, octopole, dodecapole and icosapole field. In view of the variations of the above quadrupole electrode system, it is clear that the desirable mixed field may be attained by changing the step parameters of the electrodes. Although only a quadrupole electrode system is demonstrated above, it is conceivable that variations thereof will be likewise applicable to other multipole electrode systems. Therefore detailed descriptions are omitted.

Figure 17:
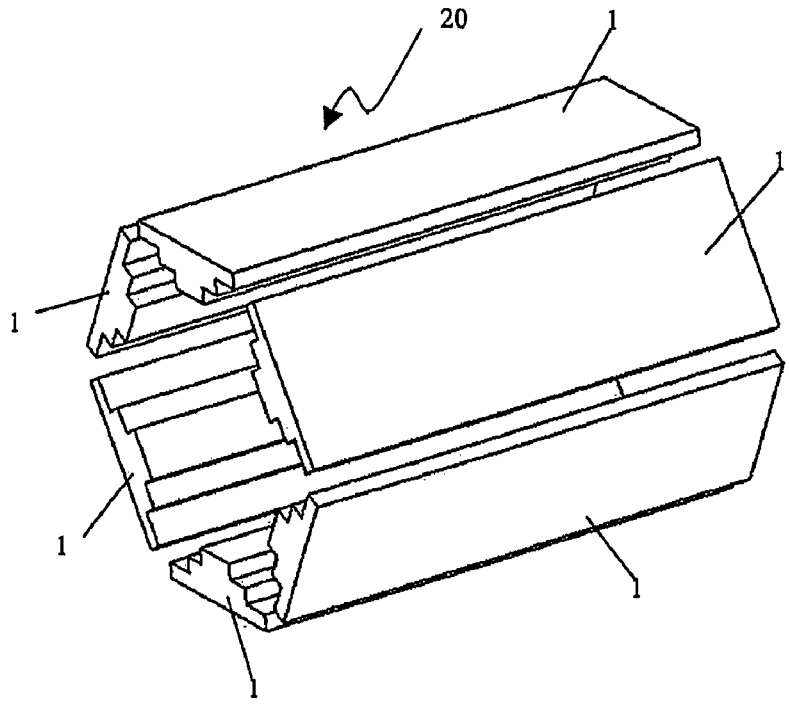
FIG. 17 is a schematic view illustrating the structure of a hexapole electrode system of the invention.

As another alternative example, said multipole electrode system may have three pairs of electrodes 1 so as to form a hexapole electrode system 20, as shown in FIG. 17.

Figure 18:
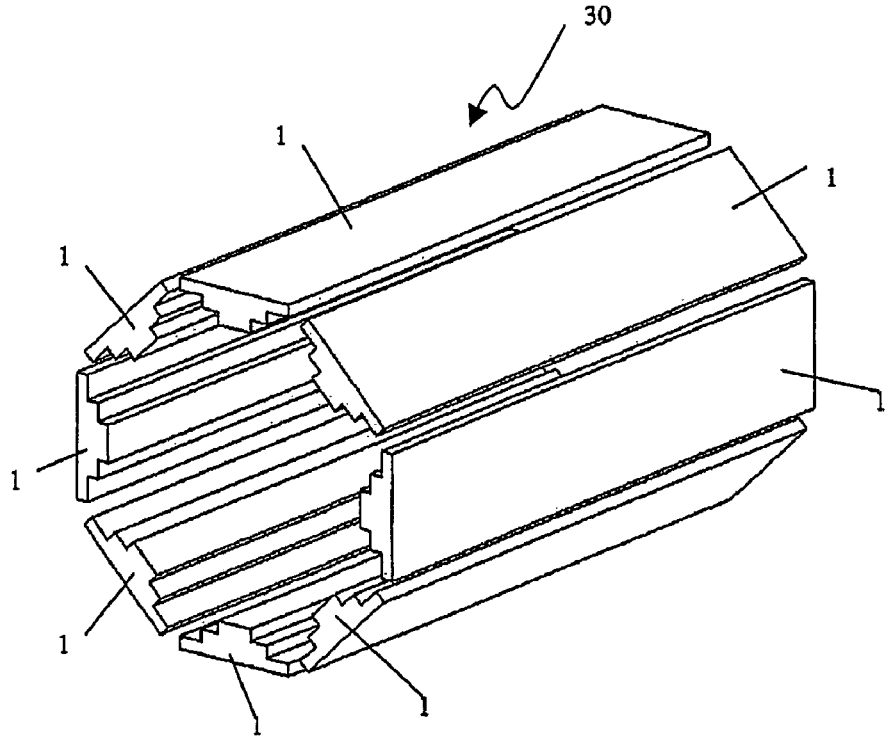
FIG. 18 is a schematic view illustrating the structure of an octopole electrode system of the invention.

As a further alternative example, said multipole electrode system may have four pairs of electrodes 1 so as to form an octopole electrode system 30, as shown in FIG. 18.

As shown in FIGS. 10 to 18, in the multipole electrode systems according to the invention, said electrodes 1 may be fixed on a same circumference centered on the z axis, with circumferential angles therebetween being equal to each other. Of course, these electrodes 1 may also be arranged around Z axis in an asymmetrical manner as required.

In the multipole electrode systems according to the invention, said power supply provides DC signals or RF signals, or combination thereof, or signals in other wave forms, or combination of various signals, so as to perform focusing and transferring of ions. As shown in FIGS. 19 to 22, the invention further proposes an ion trap 40 for mass spectrometric analysis which employs said step-like electrodes 1, comprising a quadrupole electrode system 10 with two pairs columnar electrodes 1, end electrodes 21, 22 provided at the two ends of the quadrupole electrode system 10, a RF signal that generates a RF ion capture electric field, and a DC signal that generates an axial ion capture potential well, wherein at least one side of the cross sections of at least one pair of columnar electrodes 1 is in a step-like shape with two or more steps.

Figure 19:
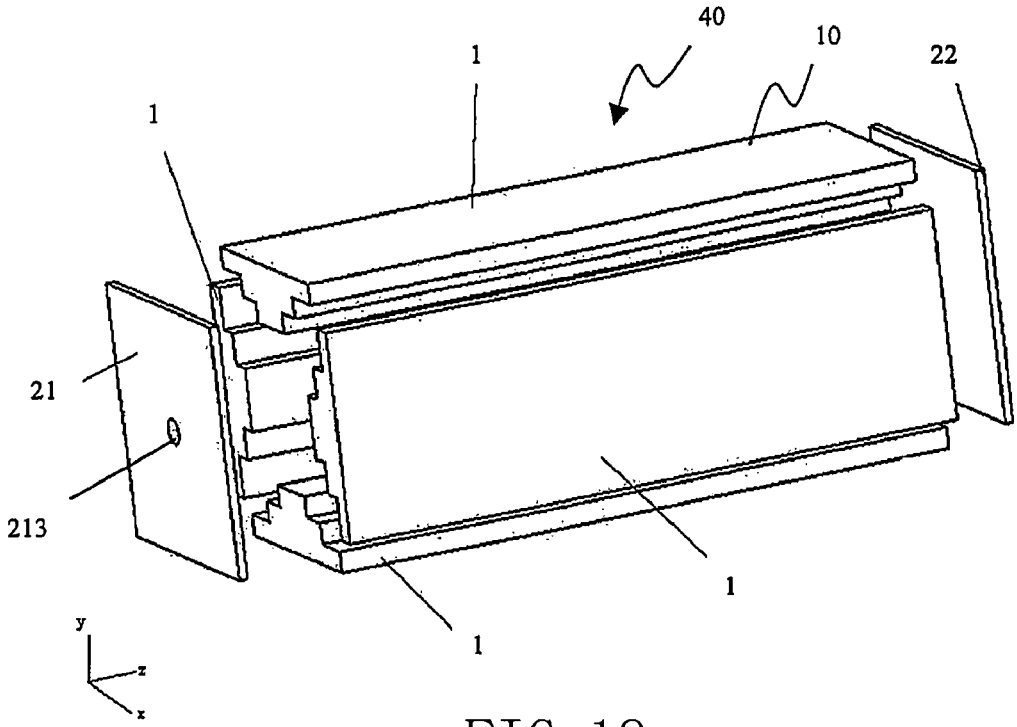
FIG. 19 is a schematic view illustrating the structure of an ion trap of the invention.

End electrodes 21, 22 mainly serve to generate a potential well in the direction of the z axis so as to confine, in the direction of the z axis, ions within the capture region of the ion trap. In the ion trap 40 according to the invention, as an alternative example, said end electrodes 21, 22 may be flat plate electrodes arranged along the x-y plane, as shown in FIG. 19.

Figure 21:
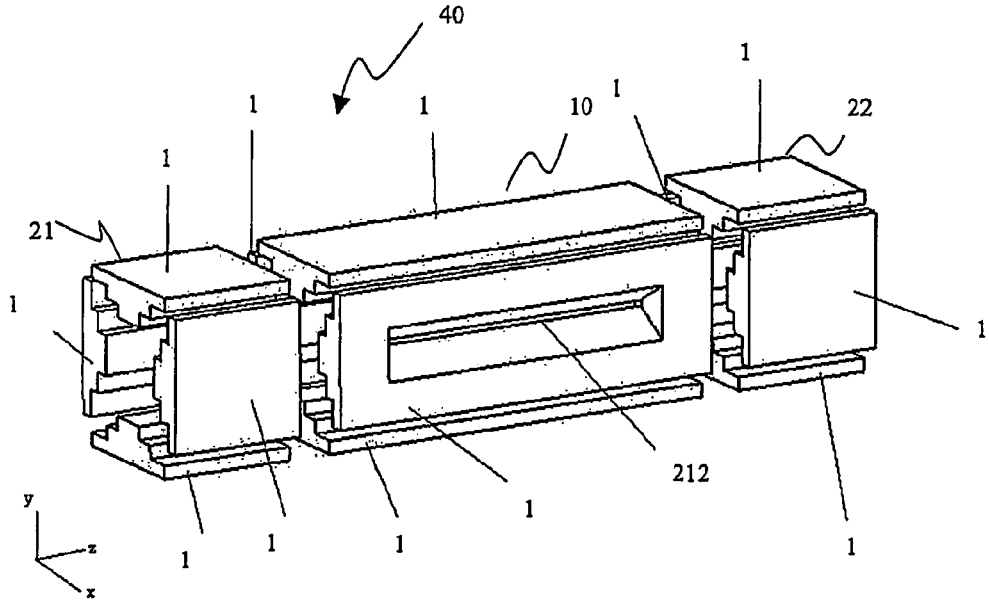
FIG. 21 is a schematic view illustrating the structure of a further ion trap of the invention.

As shown in FIG. 21, in the ion trap 40 according to the invention, as another alternative example, said end electrodes 21, 22 may be constituted by a quadrupole electrode system 10 which is parallel to the z axis and has two pairs of columnar electrodes 1. At least one side of the cross sections of at least of one pair of electrodes 1 is in a step-like shape with two or more steps.

Figure 22:
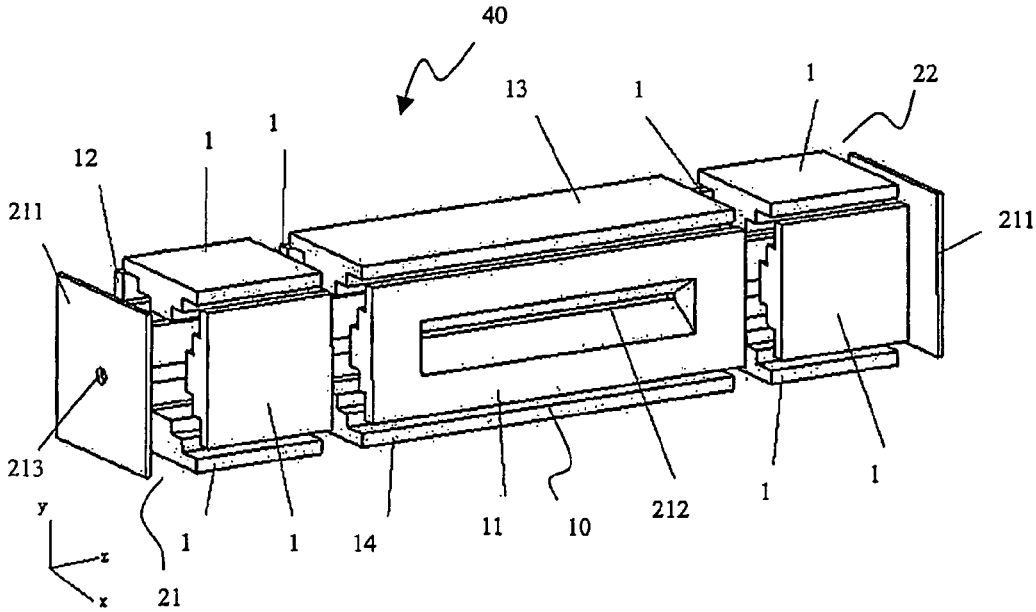
FIG. 22 is a schematic view illustrating the structure of an ion trap with slots provided to the electrodes.

As shown in FIG. 22, in the ion trap 40 according to the invention, as a further alternative example, said end electrodes 21, 22 may also be constituted by a quadrupole electrode system 10 which has two pairs of columnar electrodes 1, and flat plate electrodes 211 which are located at the ends of the quadrupole electrode system 10. At least one side of the cross sections of at least of one pair of electrodes 1 is in a step-like shape with two or more steps.

As shown in FIGS. 18 to 22, in the ion trap 40 according to the invention, it is preferable that one side or both sides of the cross sections of the two pairs of electrodes 1 are in a step-like shape with two or more steps.

In the ion trap 40 according to the invention, a mixed field composed of multipole fields with specific contributing components may be imparted to the ion trap 40 by varying the number of steps of cross sections of the electrodes 1 and the shape parameters of each step. The mixed field contains a quadrupole field and an octopole field.

In a field-shape optimizing linear ion trap 40, the relationship between the mass-to-charge ratio of trapped ions, the geometrical shape of the ion trap and the introduced RF and DC voltages may be expressed as follows, $$\frac{m}{e} = A_2 \frac{4V_{RF}}{qr_0^2\omega^2} \tag{1}$$

$$\frac{m}{e} = A_2 \frac{4V_{RF}}{qr_0^2\omega^2}$$

wherein $A_2$ is the expansion coefficient for the quadrupole component in the expansion expression of a multipole electric field, $V_{RF}$ and $U_{DC}$ are the magnitudes of the RF component and DC component of the RF signal introduced to the RF electrode, respectively, a and q are Mathieu coefficients, $r_0$ is the distance of z axis to the RF electrode, and ω is the frequency of the RF signal.

The existing theory of ion trap reveals that when the electrodes 1 have ideal hyperbolic surfaces, an ideal quadrupole field may be generated in ion capture region, with which good ion analysis results may be obtained. As compared with a linear rectangular ion trap constituted by flat plate electrodes, the ion trap constructed by the step-like electrodes 1 may generate a more significant quadrupole component, such that separation and analysis may be more efficiently realized on the target ions. Therefore, it may be considered that it has an optimized electric field shape.

In actual manufacture processes, it is considerably difficult to obtain ideal hyperbolic surfaces, which substantially limits the analysis performance of an ion trap mass analyzer. In the situation of employing the step-like electrodes 1, the field shape may be optimized by increasing the number of the steps and adjusting the dimensional parameters of each step. Theoretically, when the thickness of each step tends to infinitesimal, a RF electrode with ideal hyperbolic surfaces may be obtained in a combination manner. In actual manufacture processes, each step has a definite thickness. Given the shape and parameters of each step, a numerical simulation approach may be employed to obtain the field shape in a quadrupole electrode system formed by electrodes 1 that can be decomposed into multiple steps. On the other hand, the electrode parameters that correspond to the optimized field shape may be obtained from the numerical simulation approach, such as the number of steps, the dimensions of each step and the like. Therefore, a RF electrode 1 may be manufactured which will present an optimized field shape. Since such step-like electrodes 1 may take a shape which is simple and easy to be manufactured and assembled (for example, surfaces thereof are constituted by combination of planes, cylindrical planes, etc.), the accuracy of manufacture and assembly may be significantly improved and the manufacture cost of ion traps may be greatly decreased.

The basic frequency of the motion of ions in a quadrupole field may be expressed as $$\omega_u = \tfrac{1}{2}\beta_u\omega \tag{2}$$

wherein $$\beta = \left(a + \frac{q^2}{2}\right)^{1/2} \quad q \le 0.4. \tag{3}$$

Figure 23:
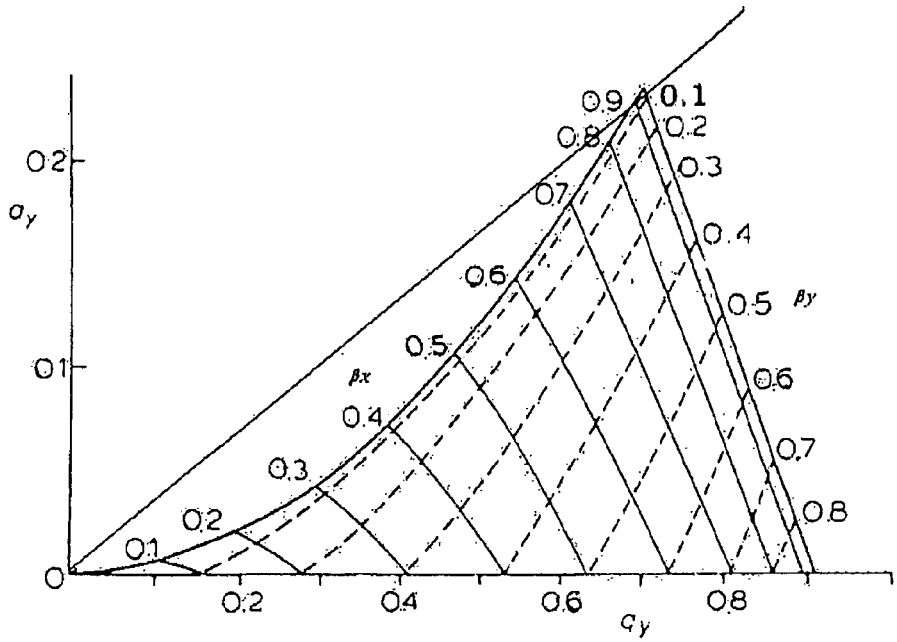
FIG. 23 is a motion stability graph of ions in the ion trap of the invention.

FIG. 23 shows a graph illustrating the motion stability of ions in an ion trap.

As indicated in the above expression, if $r_0$, ω, U, V are given, then an ion under a certain mass-to-charge ratio will have definite values for a and q, and thus correspond to a definite operation point in this stability graph. If the point is located within the stability triangle, this ion may be captured in the ion trap. The captured ions are referred to as stable ions. When the RF voltages applied across the RF electrodes 1 are constant, and the ratio of $V_{RF}$ to $U_{DC}$ is fixed, the mass-to-charge ratio m/z of a stable ion is proportional to $V_{RF}$ and thus proportional to $U_{DC}$ at some point in the stability graph, that is, corresponding to fixed values of a and q. The ions trapped in the trap may be separated, emitted, analyzed and detected by using motion stability of ions in the trap.

The basic operation process of the field-shape optimizing linear ion trap mass analyzer constructed by step-like RF electrodes 1 is as follows. In the trap, the sample gas to be analyzed is ionized into ions to be analyzed (alternatively, the sample to be analyzed may be ionized outside the trap and ions to be analyzed are then introduced into the trap). Ions collide with buffer gas and their kinetic energy is attenuated; then ions are confined within the ion capture region in the trap by the RF capture electric field and the DC capture electric field. After ions are captured, an AC signal or a signal in other wave form is applied across the electrode 1 or end electrodes 21 and 22. In this way, ions may be separated or excited with mass selectivity. When an AC voltage is applied across the end electrodes 21 and 22, the scanning RF magnitude may emit ions in the direction of the z axis such that they pass through the small holes or slots in the end electrodes 21 and 22 and get out of the ion trap. When the AC voltage is applied to an x or y electrode pair, the scanning RF magnitude may force ions to travel along the x or y direction so as to pass through slots in the x or y electrode and get out of the ion trap.

Figure 20:
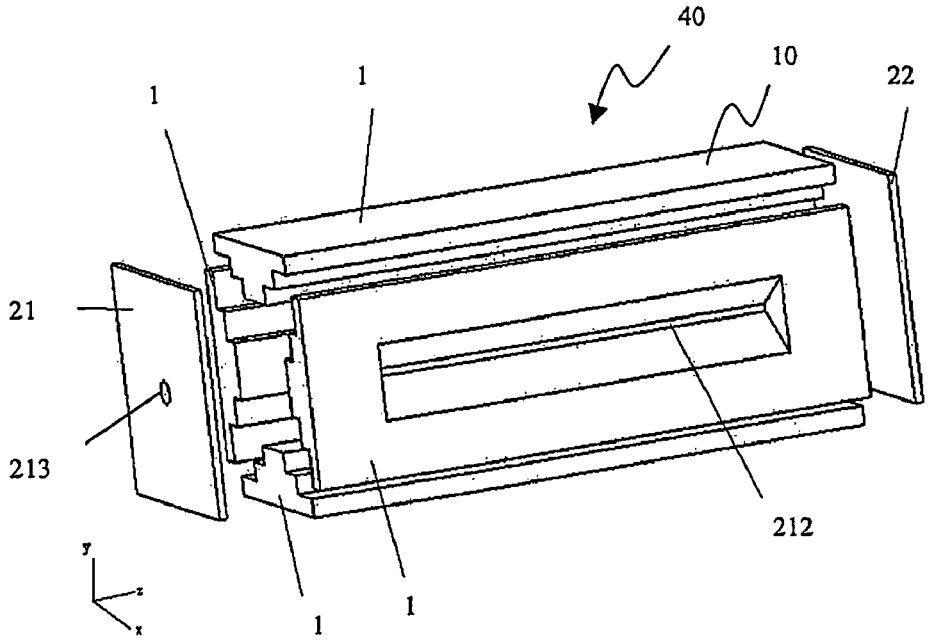
FIG. 20 is a schematic view illustrating the structure of another ion trap of the invention.

As shown in FIGS. 20 to 22, in the ion trap 40 according to the invention, at least one of electrodes 1 or the end electrodes 21 and 22 are provided with slots 212 or small holes 213 through which ions are introduced thereinto or discharged therefrom. As shown in FIGS. 20 to 22, in the field-shape optimizing linear ion trap, a slot 212 which is parallel to the z axis may be provided on the RF electrode 1, and an AC signal may be applied to the x or y electrode pair, such that ions may be excited or be discharged out of the ion trap along the x or y axis. Alternatively, the electrode plates of end electrodes 21, 22 may also be provided with small holes 213 or slots such that ions may be excited or discharged out of the ion trap along the z axis. The above-mentioned methods may be arbitrarily combined in such a way that ions could be excited or discharged out of the ion trap in various directions.

Figure 24:
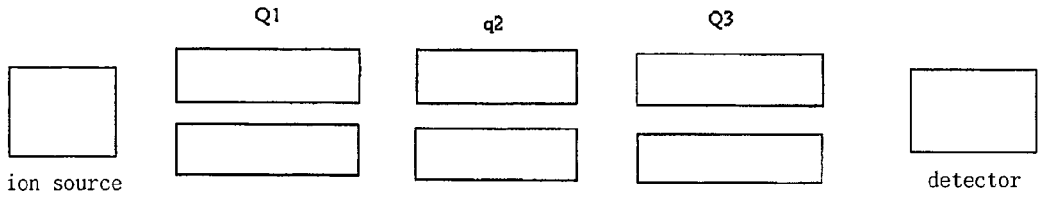
FIG. 24 is a schematic view illustrating a situation in which three ion traps of the invention are arranged in serial to conduct $MS^n$.

A plurality of field-shape optimizing linear ion traps of large capacity may constitute a multi-stage ion-treating system, i.e., a tandem ion trap mass analysis system. The ion traps at adjacent stages in the tandem ion trap mass analysis system are coupled in such a manner that ions may successively pass through various ion trap stages and $MS^n$ analysis experiments may be efficiently conducted. FIG. 24 shows a three-stage ion-treating system which is constituted by three field-shape optimizing linear ion traps of large capacity, which may be used for carry out three-stage MS-MS analysis experiments efficiently.

Based on the above descriptions, the concrete operation modes of the ion trap and its mass analyzer proposed in the invention will be explained by taking an example of a field-shape optimizing linear ion trap of large capacity and its mass analyzer, which are constituted by RF electrodes 1 composed of rectangular flat plate electrodes and rectangular block-like steps.

FIG. 22 shows a field-shape optimizing linear ion trap of large capacity which is constituted by RF electrodes 1 composed of rectangular block-like steps. This ion trap includes RF electrodes composed by x electrodes 11, 12 and y electrodes 13, 14 parallel to the z axis. Each electrode is formed by combining at least three steps. RF electrodes are arranged in the x-y plane in the counterclockwise order of 11-13-12-14, with the angular interval therebetween being 90 degrees, thus an ion capture region is defined. Slots parallel to the z axis are provided at the centers of the x electrodes 11 and 12. A RF power supply connected to the x and y electrode pairs provides RF voltages across the x electrode pair and the y electrode pair so as to generate a RF ion capture field in the x-y plane. An end electrode pair 21, 22, located at the two ends of the ion capture region defined by the x and y electrode pairs, includes an electrode plate 211 and a quadrupole electrode system 10 composed of step-like electrodes 1. Small holes 213 are provided at the centers of the electrode plates of the end electrodes 21, 22. A DC power supply connected to the end electrode pair provides a DC capture potential trap along the z axis direction between the two end electrodes 21 and 22, such that ions are confined within the ion capture regions. An AC power supply connected to the x electrode pairs provides AC voltages across the x electrodes 1 and 2 so as to excite or discharge ions along the x axis direction. The AC power supply may also be connected to the electrode plates of the end electrode 21 and 22 to provide AC voltages across the end electrodes 21 and 22, so as to excite or discharge ions along the x axis direction.

Like the ion traps of the prior art, the field-shape optimizing linear ion trap of large capacity may carry out storage and separation of ions. When the DC component applied to the ion trap vanishes, its operation state corresponds to the q axis in the stability graph shown in FIG. 23. The initial RF magnitude will determine the lower limit of stable mass-to-charge ratios of ions. All the ions that have a mass-to-charge ratio larger than or equal to the lower limit will be captured by the ion trap and stored therein.

Ion separation by using the ion trap may be conducted in two operation manners, i.e., RF/DC separation and AC waveform separation. As shown in FIG. 23, based on the ion motion stability graph, the approach of RF/DC separation changes the motion state of ions at the margins of the stability graph from being stable to unstable, such that the unstable ions are discharged from the ion trap. The operation process of the RF/DC separation approach is to select ions to be hold in the ion trap according to the separation requirements, calculate state parameters $(a_i,q_i)$ of the held ions, locate state points $(a_i,q_i)$ in the vicinity of the vertexes of the stability triangular, adjust the RF component on the y electrodes according to the results and introduce DC components simultaneously, such that the state points of the target ions change to $(a_i,q_i)$; at that time, other ions will fall into the unstable region, thus target ions are separated from other ions.

The approach of AC waveform separation is based on the relationship between the basic frequency of ion motions and ion states. The responsive vibration magnitude in the z axis direction after excitation is proportional to Fourier transform of the excitation waveform itself. The response of ions is irrelevant to the frequency of axial vibrations or the mass-to-charge ratios of the ions. The excitation of ions having a mass-to-charge ratio of m/z is solely determined by the excitation magnitude at the frequency corresponding to the mass-to-charge ratio. Pivoting on the basic frequency of ion motions, the axial vibration magnitude of ions after excitation may be determined without accurately calculating the ion trajectories. Thus, only if an AC waveform corresponding to the separation purpose is applied onto the corresponding electrodes, a selective excitation and discharge on multiple target ions may be realized simultaneously.

In a field-shape optimizing linear ion trap of large capacity, it is frequently necessary to resonantly excite and discharge a single target ion selectively, which is referred to as AC resonant excitation and discharge. This is essentially a particular case of the AC waveform separation, that is, the basic frequency of motions of the target ion is a frequency value, not a frequency band.

In the field-shape optimizing linear ion trap of large capacity as shown in FIG. 22, an AC signal is applied to the two x electrodes, wherein the non-discharging electrode plate bears a positive signal and discharging electrode plate bears a negative signal. This ensures that positive ions will be discharged out of the ion trap from the outlet electrode plate. When ions to be detected are negative ions, the non-discharging electrode plate will bear a negative signal and the discharging electrode plate will bear a positive signal.

Through irons selection, the mass analyzer of a field-shape optimizing linear ion trap of large capacity makes stable target ions become unstable such that the ions are discharged out of the ion trap and detection could be carried out. Selective unstable detection can be conducted in two manners, that is, boundary discharge and AC resonant discharge.

In the manner of boundary discharge, the stable boundary points on the q axis of the stability graph shown in FIG. 23 are taken as operation points, and the magnitude of the DC voltage vanishes. Through scanning the RF voltage magnitude (ascent scanning), the ions enter an unstable state in an order from a lower mass-to-charge ratio to a higher one. Unstable ions will be discharged out of the ion trap to reach the detection system outside of the ion trap. The corresponding mass spectrogram may be obtained through receiving and magnifying the corresponding electric signals.

The approach of AC resonant discharge makes use of the relationship between the basic ion motion frequency and the state thereof. The basic ion motion frequency is changed by scanning RF. When the basic frequency of an ion is equal to the frequency of an AC signal, the vibration magnitude in the x axis direction will increase significantly. The ion will depart from the ion trap from the slot at the center of the x electrode plate and enter the outside detection circuit. A tandem multi-stage system of field-shape optimizing linear ion traps of large capacity may be used to carry out $MS^n$ analysis experiments efficiently.

FIG. 24 shows that a three-stage ion treating system may be constituted by three field-shape optimizing linear ion traps of large capacity, and thereby three stage MS-MS analysis experiments may be conducted. In this three-stage tandem system, the mass analyzers of the three field-shape optimizing linear ion traps of large capacity are arranged in series to form a QqQ series. Its working manner is as follows. Q1 and Q3 are normal mass analyzers. Only RF voltages, that is, no DC voltages are applied to q2. The RF field focalizes all ions and allows them to pass through. Thus, ions may undergo metastable fragmentation or collision-induced dissociation in q2. Q1 can select interested ions from the ion source, such that they may undergo dissociations in q2. The dissociation product is delivered into Q3, such that conventional mass spectrometric analysis may be performed to deduce the composition structure of molecules.

The field-shape optimizing ion trap and the mass analyzer proposed in the invention employ step-like electrodes 1. The design process of the step-like electrodes 1 may be as follows. According to the desired field shape, the type of the step is determined and a computational model is established based on the determined step type. A mixed field composed of multipole fields with specific contributing components, i.e., the required optimized field shape may be obtained by varying the configurations, such as the number of the steps and the dimensional parameters of each step, so as to determine the boundary conditions and the optimal combination of the electrodes. A general optimized field shape may be a quadrupole field, or a mixed field comprised of a quadrupole field and an octopole field, or a mixed field comprised of a quadrupole field and other multipole fields.

Figure 25:
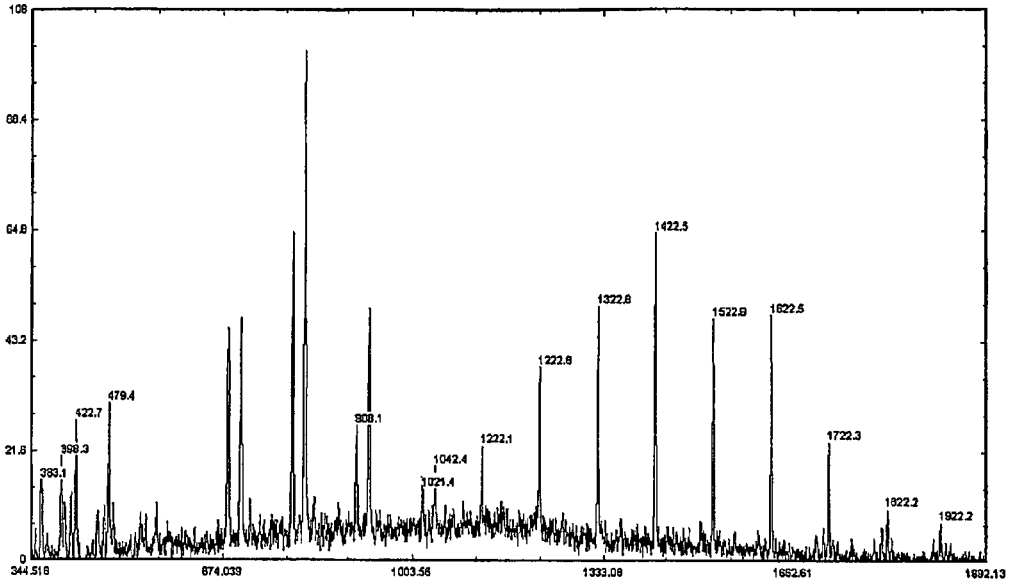
FIG. 25 is a mass spectrogram of a sample that is obtained from the mass spectrometric measurement experiments using the ion trap mass analyzer manufactured by the structure shown in FIG. 11.
Figure 26:
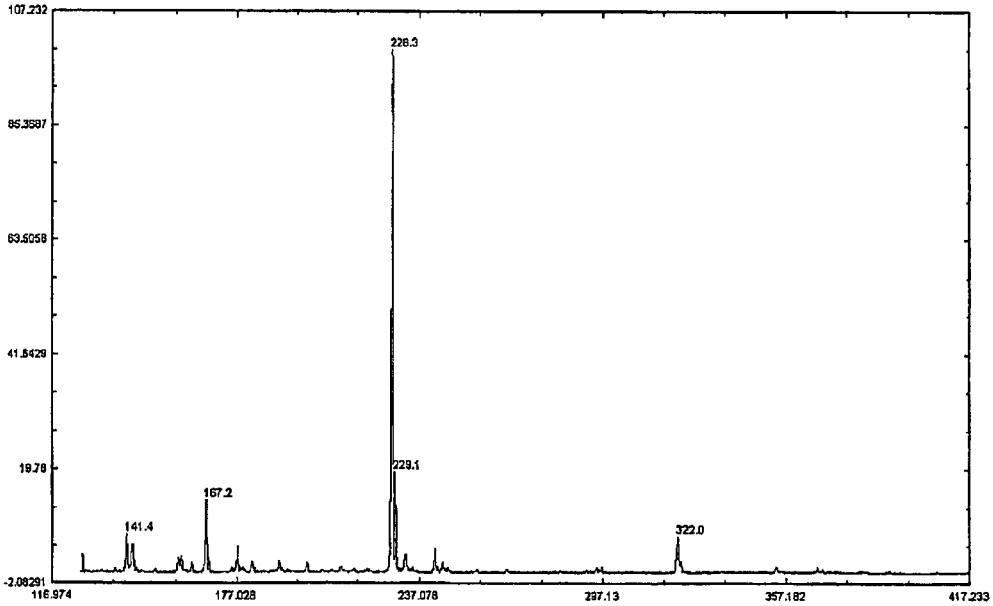
FIG. 26 is a mass spectrogram of another sample that is obtained from the mass spectrometric measurement experiments using the ion trap mass analyzer manufactured by the structure shown in FIG. 11.
Figure 27:
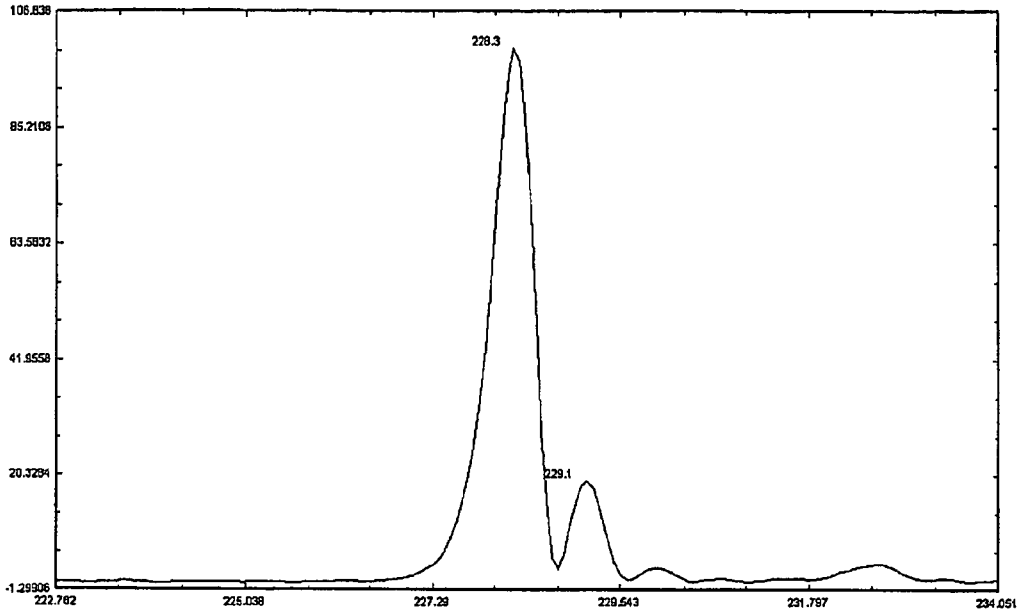
FIG. 27 is a partially enlarged view of FIG. 26.

FIGS. 25 to 27 show mass spectrometric experiment results obtained by using the ion trap mass analyzer constructed by the structure shown in FIG. 11 according to the invention. Wherein FIG. 25 shows a mass spectrogram in which a calibration mixture Ultramark 1621 from PCR Company in USA was taken as the sample, which indicates that the mass range is up to 2000 Da when using the ion trap according to the invention as the mass analyzer. FIGS. 26 and 27 are a mass spectrogram and a partially enlarged view thereof when arginine is used as the sample for a full brand scanning, indicating that a better peak shape and a higher resolution may be achieved by means of this ion trap.

What is claimed is:

1. An electrode for mass spectrometric analysis, with the electrode being in a columnar form, characterized in that, at least one side of the cross sections of the columnar electrode has a step-like shape with two or more steps, wherein an edge line between two steps extends along a longitudinal direction of the electrode, and step widths in a cross direction of the electrode with the side in a step-like shape decrease step by step.

2. The electrode for mass spectrometric analysis according to claim 1, characterized in that, both sides of the cross sections of the electrode have a step-like shape with two or more steps.

3. The electrode for mass spectrometric analysis according to claim 1, characterized in that, the shapes of the two sides of the cross sections of the electrode are arranged in a symmetrical manner, or in an asymmetrical manner.

4. The electrode for mass spectrometric analysis according to claim 1, characterized in that, the two sides of the cross sections of the electrode have a same number of steps.

5. The electrode for mass spectrometric analysis according to claim 1, characterized in that, the step-like side with two or more steps of the electrode is integrally manufactured.

6. The electrode for mass spectrometric analysis according to claim 1, characterized in that, the electrode is formed by combining individual steps that have been manufactured respectively.

7. The electrode for mass spectrometric analysis according to claim 1, characterized in that, the side of each step of the electrode with step-like cross sections has a shape of a step surface with right angles, or a cylindrical surface, or a hyperbolic surface or an oval surface.

8. The electrode for mass spectrometric analysis according to claim 1, characterized in that, each step of the cross sections of the electrode has a rectangular shape.

9. A multipole electrode system for mass spectrometric analysis, comprising one or more pairs of columnar electrodes, and a power supply connected to the electrodes, said columnar electrodes are peripherally arranged in a straight columnar shape centered on a Z axis parallel to the generatrix of the electrode, characterized in that, at least one side of the cross sections of at least one pair of the electrodes has a step-like shape with two or more stages, wherein an edge line between two steps extends along a longitudinal direction of each electrode, and step widths in a cross direction of the electrodes with the side in a step-like shape decrease step by step from an outer side to an inner side, and wherein two longitudinal sides with a step-like shape of the at least one pair of electrodes face one another.

10. The multipole electrode system for mass spectrometric analysis according to claim 9, characterized in that, at least one side of cross sections of all the electrodes of the multipole electrode system has a step-like shape with two or more steps.

11. The multipole electrode system for mass spectrometric analysis according to claim 9, characterized in that, both sides of the cross sections of the step-like electrodes have a step-like shape with two or more steps.

12. The multipole electrode system for mass spectrometric analysis according to claim 11, characterized in that, the two sides of the cross sections of the columnar electrodes have a same number of steps.

13. The multipole electrode system for mass spectrometric analysis according to claim 9, characterized in that, the shapes of the two sides of the cross sections of the columnar electrodes are arranged in a symmetrical manner, or in an asymmetrical manner.

14. The multipole electrode system for mass spectrometric analysis according to claim 9, characterized in that, the step-like side with two or more steps of the electrodes are integrally manufactured.

15. The multipole electrode system for mass spectrometric analysis according to claim 9, characterized in that, the step-like electrodes are formed by combining individual steps that have been manufactured respectively.

16. The multipole electrode system for mass spectrometric analysis according to claim 9, characterized in that, the side of each step of the step-like electrodes has a shape of a step surface with right angles, or a cylindrical surface, or a hyperbolic surface or an oval surface.

17. The multipole electrode system for mass spectrometric analysis according to claim 9, characterized in that, each step of the cross sections of the step-like electrodes has a rectangular shape.

18. The multipole electrode system for mass spectrometric analysis according to claim 9, characterized in that, the multipole electrode system has two pairs of electrodes so as to form a quadrupole electrode system.

19. The multipole electrode system for mass spectrometric analysis according to claim 9, characterized in that, the multipole electrode system has three pairs of electrodes so as to form a hexapole electrode system.

20. The multipole electrode system for mass spectrometric analysis according to claim 9, characterized in that, the multipole electrode system has four pairs of electrodes so as to form an octopole electrode system.

21. The multipole electrode system for mass spectrometric analysis according to claim 9, characterized in that, the electrodes are fixed on a same circumference centered on the Z axis, with circumferential angles therebetween being equal to each other.

22. The multipole electrode system for mass spectrometric analysis according to claim 9, characterized in that, the power supply provides a DC signal or a RF signal, or a combination thereof.

23. The multipole electrode system for mass spectrometric analysis according to claim 9, characterized in that, a mixed field composed of multipole fields with specific contributing components may be obtained by the multipole electrode system by varying the multipole electrode system with respect to the number of steps of cross sections of the electrode and the shape parameters of each step.

24. The multipole electrode system for mass spectrometric analysis according to claim 23, characterized in that, the mixed field contains a quadrupole field and an octopole field.

25. An ion trap for mass spectrometric analysis, comprising, a quadrupole electrode system with two pairs of columnar electrodes;

end electrodes located on two ends of the quadrupole electrode system;

a RF signal generating a RF ion capture electric field; and a DC signal generating an axial ion capture potential well;

characterized in that, at least one side of the cross sections of at least one pair of columnar electrodes has a step-like shape with two or more steps, wherein an edge line between two steps extends along a longitudinal direction of each electrode, and the step widths in a cross direction of the electrodes with the side in a step-like shape decrease step by step from an outer side to an inner side, and wherein two longitudinal sides with a step-like shape of each pair of electrodes face one another.

26. The ion trap for mass spectrometric analysis according to claim 25, characterized in that, the end electrodes are flat plate electrodes.

27. The ion trap for mass spectrometric analysis according to claim 25, characterized in that, the end electrodes are constituted by a quadrupole electrode system with two pairs of columnar electrodes, wherein at least one side of the cross sections of at least one pair of the columnar electrodes has a step-like shape with two or more steps.

28. The ion trap for mass spectrometric analysis according to claim 25, characterized in that, the end electrode is formed through combining a quadrupole electrode system with two pairs of columnar electrodes and a flat plate electrode located at end of the quadrupole electrode system, wherein at least one side of the cross sections of at least one pair of the columnar electrodes has a step-like shape with two or more steps.

29. The ion trap for mass spectrometric analysis according to claim 25, characterized in that, at least one side of each cross section of the two pairs of the columnar electrodes has a step-like shape with two or more steps.

30. The ion trap for mass spectrometric analysis according to claim 25, characterized in that, both sides of each cross section of the columnar electrodes have a step-like shape with two or more steps.

31. The ion trap for mass spectrometric analysis according to claim 25, characterized in that, the shapes of the two sides of the cross sections of the step-like electrodes are arranged in a symmetrical manner, or in an asymmetrical manner.

32. The ion trap for mass spectrometric analysis according to claim 25, characterized in that, the two sides of the cross sections of the columnar electrodes have a same number of steps.

33. The ion trap for mass spectrometric analysis according to claim 25, characterized in that, the step-like side with two or more steps of the electrodes are integrally manufactured.

34. The ion trap for mass spectrometric analysis according to claim 25, characterized in that, the columnar electrodes are formed by combining individual steps that have been manufactured respectively.

35. The ion trap for mass spectrometric analysis according to claim 25, characterized in that, the side of each step of the columnar electrodes has a shape of a step surface with right angles, or a cylindrical surface, or a hyperbolic surface or an oval surface.

36. The ion trap for mass spectrometric analysis according to claim 25, characterized in that, each step of the cross sections of the columnar electrodes has a rectangular shape.

37. The ion trap for mass spectrometric analysis according to claim 25, characterized in that, at least one of the columnar electrodes or the end electrodes is provided with slots or small holes for introducing or discharging ions.

38. The ion trap for mass spectrometric analysis according to claim 25, characterized in that, a mixed field composed of multipole fields with specific contributing components may be obtained by the ion trap by varying the number of steps of cross sections of the columnar electrodes and the shape parameters of each step.

39. The ion trap for mass spectrometric analysis according to claim 38, characterized in that, the mixed field contains a quadrupole field and an octopole field.

40. The ion trap for mass spectrometric analysis according to claim 25, characterized in that, a plurality of said ion traps are serially arranged to constitute a multi-stage ion treating system for conducting $MS^n$ analysis experiments.

* * * * *